United States Patent [19]

Finamore et al.

[11] Patent Number: 5,033,486

[45] Date of Patent: Jul. 23, 1991

[54] METHOD FOR ATTACHING A HAIRPIECE TO THE SCALP

[75] Inventors: Paul V. Finamore, Chicago; Joseph Majewski, Addison, both of Ill.

[73] Assignee: Hairline Creations, Inc., Chicago, Ill.

[21] Appl. No.: 492,628

[22] Filed: Mar. 13, 1990

[51] Int. Cl.[5] ..... A41G 5/00

[52] U.S. Cl. ..... 132/201; 132/53; 132/54

[58] Field of Search ..... 132/54, 55, 56, 53, 132/200, 201; 623/15

[56] References Cited

U.S. PATENT DOCUMENTS

| | | | |
|---|---|---|---|
| 2,175,693 | 10/1939 | Jacoby | 132/53 |
| 3,420,249 | 1/1969 | Bonham | 132/201 |
| 3,421,521 | 1/1969 | Rich, Jr. | 132/201 |
| 3,520,309 | 7/1970 | Lane et al. | 132/53 |
| 3,710,452 | 1/1973 | Hamrick | 132/53 |
| 4,176,669 | 12/1979 | Levin | 132/201 |
| 4,517,999 | 5/1985 | Finamore | 132/201 |
| 4,819,671 | 4/1989 | Walker | 132/54 |
| 4,966,173 | 10/1990 | Russell | 132/54 |

*Primary Examiner*—John J. Wilson
*Assistant Examiner*—Frank A. LaViola
*Attorney, Agent, or Firm*—Richard Bushnell

[57] ABSTRACT

A hairpiece is attached and fitted by first removing from the scalp of the wearer, a length of the wearer's natural hair along a band below the wearer's natural hair line, and attaching the hairpiece along the band of removed hair in order to produce a long-term and closely fitting securement of the hairpiece to the scalp. Preferably, the band of removed natural hair extends along a generally circumferential length around the wearer's scalp while retaining a small amount of short strands of the natural hair within the band to promote bonded adhesion of the hairpiece foundation along the band.

11 Claims, 1 Drawing Sheet

METHOD FOR ATTACHING A HAIRPIECE TO THE SCALP

BACKGROUND OF THE INVENTION

The present invention relates to hairpiece construction and fitting, and more particularly relates to improvements in securement of hairpieces for extended wear and natural appearance.

Construction developments for hairpiece foundations have greatly improved the natural appearance and comfort to to the wearer for example as described in U.S Pat. No. 4,517,999 which is incorporated by reference herein for extensive discussion of materials and construction methods.

While many hairpieces are designed for readily removable fitting and securement such as with double-sided tape, longer term or semi-permanent hairpiece securement has been developed in which the hairpiece is clipped to the wearer's scalp or the wearer's natural hair is braided, weaved or threaded to the hairpiece. These long-term securement methods can have disadvantages in comfort, stability, and natural appearance. These disadvantages are eliminated by the fitting of hairpieces in accordance with the present invention.

SUMMARY OF THE INVENTION

In accordance with the present invention, a hairpiece is attached and fitted by first removing from the scalp of the wearer, a length of the wearer's natural hair along a band below the wearer's natural hair line, and attaching the hairpiece along the band of removed hair in order to produce a long-term and closely fitting securement of the hairpiece to the scalp. Preferably, the band of removed natural hair extends along a generally circumferential length around the wearer's scalp while retaining a small amount of short strands of the natural hair within the band to promote bonded adhesion of the hairpiece foundation along the band.

DESCRIPTION OF THE ILLUSTRATED EMBODIMENT

Figure 1:
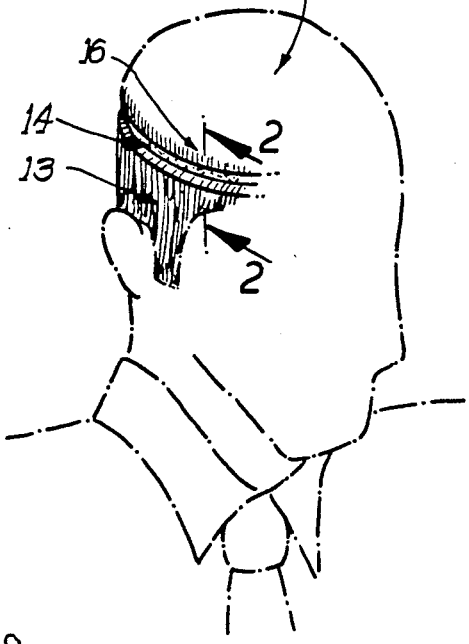
FIG. 1 is a perspective view of a head to be fitted with a hairpiece and showing the removal of a band of the wearer's own hair in an embodiment of the fitting method according to the present invention.
Figure 2:
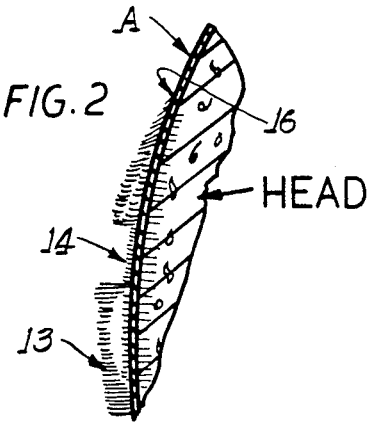
FIG. 2 is a cross-sectional view along the line 2—2 in FIG. 1.
Figure 7:
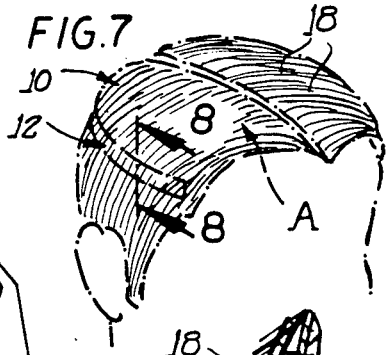
FIG. 7 is a perspective view showing the fitted hairpiece and attachment to the wearer's head along the band.

Referring to FIGS. 1 and 7, the balding area A on the head of the wearer is covered by a hairpiece generally designated by reference character 10. The hairpiece 10 generally can have any construction, but preferably has a reticulate, plastic mesh foundation. Such reticulate foundation enables the wearer's scalp to breath and therefore promotes improved comfort for long-term wear. As shown in FIG. 7, the foundation of the hairpiece 10 has a generally circumferential border 12 of polyurethane film or similar flexible material which is arranged in the hairpiece foundation to correspond with or congruently overlap a generally circumferential band of removed natural hair 14 as shown in FIGS. 1 and 2. The band 14 of removed natural hair is located below the natural hair line 16 which generally defines the lower periphery of the balding area A as shown in FIGS. 1 and 2. When the hairpiece 10 has a reticulate, mesh foundation, the circumferential polyurethane border 12 (which has a gap corresponding to the wearer's forehead) can be bonded on the mesh using a fusing adhesive, for example, a mixture of dimethylformamide and toluene in a ratio of 3:2 parts by weight. The mesh-border foundation is conventionally vacuum or heat formed to the contour of the wearer's scalp and the intended hair removal band 14. The hair strands 18 of the hairpiece 10 are then knotted into the mesh and pulled through the film border 12 in conventional manner after which the hair strands can be sealed, when needed, typically with a polyurethane based sealer.

Figure 3:
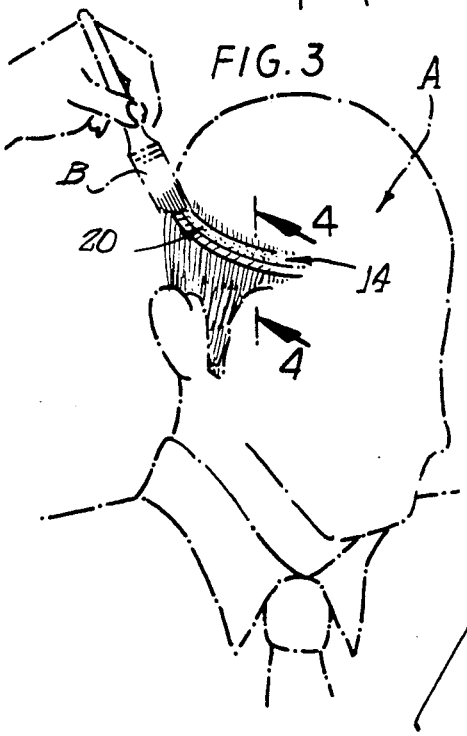
FIG. 3 is a perspective view similar to FIG. 1 showing the application of adhesive agents to the exposed band of scalp.
Figure 4:
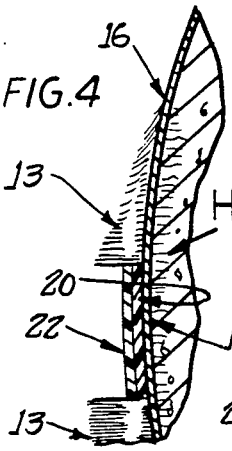
FIG. 4 is a cross-sectional view along the line 4—4 in FIG. 3.
Figure 6:
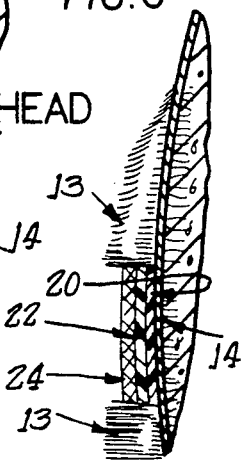
FIG. 6 is a sectional view similar to FIG. 4 showing the layers of adhesive and gauze applied on the band.
Figure 5:
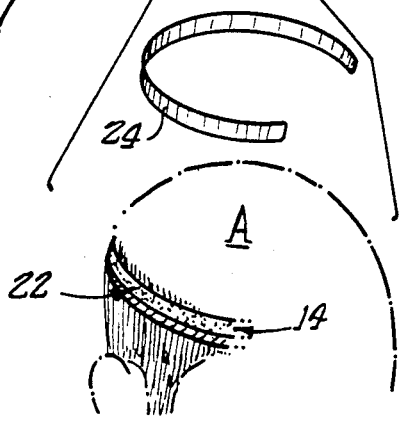
FIG. 5 is a perspective view similar to FIGS. 1 and 3 and showing application of a gauze strip over adhesive agents applied on the band.
Figure 8:
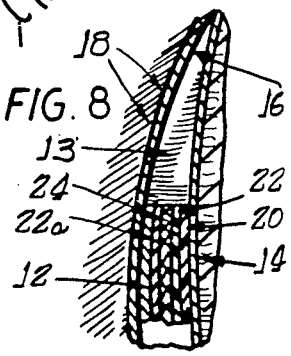
FIG. 8 is a sectional view similar to FIGS. 4 and 6 showing the layered structure of the securement of the fitting hairpiece along the band.

In shaving or otherwise removing the wearer's natural hair along the band 14 in the range of approximately ½ to ¾ inch wide, a small amount of short hair is preferably left to improve bonding of a skin sealer and adhesive, such as a typical silicone material, for example a mixture of diemethylpolysiloxane and trichlorofluoroethane; the silicone sealer 20 can be brushed along the scalp band 14 as shown in FIG. 3. Referring to FIG. 4, an additional adhesive 22 is applied over the sealer 20 along the band 14. The adhesive 22 preferably also has a silicone composition, such as a typical silicone medical adhesive commercially available under the trademark SILASTIC® from Dow Corning Corporation. Thereafter, a strip of conventional sterile gauze 24 is laid on the adhesive 22 as shown in FIGS. 5 and 6. Another layer of silicone adhesive **22*a* is applied over the gauze 24 and the adhesive layer 22*a* is then allowed to cure for approximately 10–15 minutes. Thereafter, the hairpiece 10 can be fitted to cover the balding area A, and the foundation border film 12 is aligned so that it provides circumferential bonding to the adhesive layer 22*a* as shown in FIG. 8, preferably with an additional prior application of adhesive directly to the circumferential surface of the foundation border 12**.

The circumferentially distributed securement of the hairpiece 10 along the scalp band 14 enables omission of any adhesive at the upper balding area A and therefore allows the hairpiece 10 to lay very flat, in comparison with alternative fitted hairpieces. Optionally, in some cases, corners of the hairpiece foundation can be stitched to the scalp band for additional securement. Additionally, the fitted hairpiece in accordance with the present invention eliminates the need for any hair braiding or weaving, nor any clipping of the hairpiece, so that there is no thread to catch a comb. Since the hairpiece securement is spread over the scalp, there is no localized pulling and the wearer's sleeping is more comfortable. Most importantly, since the circumferential adhesion of the hairpiece will not loosen with the growth of the wearer's natural hair, the hairpiece can be worn continuously on a long-term basis, for example eight weeks, with complete stability against displacement of the hairpiece even during athletic activity. Furthermore, the long-term securement of the hairpiece eliminates any need for the wearer to be reminded of removal of the hairpiece or its application.

While particular embodiments of the hairpiece and fitting method have been described herein, it will be obvious to those skilled in the art that changes and modifications in various aspects may be made without departing from the broad scope of the invention. Consequently, the scope of the invention is not limited by any particular embodiment but is defined by the appended claims and equivalents thereof.

What is claimed is:

1. A method for fitting a hairpiece comprising removing, from the scalp of a wearer, a length of natural hair along a band below a natural hair line and attaching a hairpiece to said band resulting from the removed natural hair in order to produce a long term and closely fitting securement of said hairpiece to the scalp.

2. A method according to claim 1, wherein the band of removed natural hair extends along a generally circumferential length around the wearer's scalp.

3. A method according to claim 1, wherein said attaching step comprises applying a first bonding agent to said scalp band.

4. A method according to claim 3, wherein said attaching step further comprises a second application of bonding agent.

5. A method according to claim 4, further comprising applying a strip of fabric material upon said bonding agent prior to said application of said hairpiece thereover.

6. A method according to claim 5, wherein said fabric material comprises perforate gauze.

7. A method according to claim 1, wherein said attaching step comprises applying a bonding agent to a foundation surface on said hairpiece corresponding to said scalp band for adhesion thereto.

8. A method according to claim 1, wherein said hairpiece comprises a reticulate foundation body at least partially surrounded by a film border thereon having a configuration corresponding to said scalp band for adhesion of said border film thereto.

9. A method according to claim 1, wherein said natural hair removing step leaves a small amount of short strands of said natural hair within said band to promote adhesive bonding of said hairpiece thereto.

10. A method for fitting a hairpiece comprising: removing from the scalp of a wearer, a length of natural hair along a band spaced below a natural hair line to create a remaining row of natural hair extending between said band and said natural hair line, and attaching a hairpiece to said band in order to produce a long-term and closely fitting securement of said hairpiece.

11. A method according to claim 10, wherein said row of remaining natural hair extends generally parallel to said band.

* * * * *